United States Patent [19]

Quaintance et al.

[11] 4,387,919

[45] Jun. 14, 1983

[54] PORTABLE AUXILIARY DOOR LOCK

[76] Inventors: Laythol W. Quaintance, Rte. 1, Box 20, Florence, Ariz. 85232; Dennis W. Quaintance, 714 Francis King St., Greensboro, N.C. 27410

[21] Appl. No.: 300,435

[22] Filed: Sep. 8, 1981

[51] Int. Cl.[3] ..... E05C 19/18

[52] U.S. Cl. ..... 292/296

[58] Field of Search ..... 292/256.75, 288, 289, 292/290, 291, 292, 293, 294, 295, 296

[56] References Cited

U.S. PATENT DOCUMENTS

| | | | |
|---|---|---|---|
| 337,924 | 3/1886 | Chase . | |
| 462,490 | 11/1891 | Kerwin . | |
| 576,467 | 2/1897 | Nagle . | |
| 645,914 | 3/1900 | Dotson . | |
| 792,966 | 6/1905 | Coleman et al. . | |
| 982,017 | 1/1911 | Packard . | |
| 1,033,255 | 7/1912 | Lochhead | 292/296 |
| 1,055,830 | 3/1913 | Tafe | 292/291 |
| 1,252,003 | 1/1918 | Hall . | |
| 1,339,856 | 5/1920 | Moore . | |
| 1,672,166 | 6/1928 | Lochhead . | |
| 1,977,430 | 10/1934 | Dalton | 292/296 |
| 2,161,673 | 3/1937 | Hammond | 292/294 |
| 2,600,584 | 6/1952 | Snell | 77/63 |
| 2,673,112 | 3/1954 | Andrews | 292/296 |
| 2,969,253 | 1/1961 | Schettl | 292/294 |
| 3,429,151 | 2/1969 | Weingart | 70/14 |
| 3,494,653 | 2/1970 | Steele | 292/291 |
| 4,043,578 | 8/1977 | Downs | 292/290 |
| 4,200,317 | 4/1980 | Polselli et al. | 292/293 |
| 4,254,976 | 3/1981 | Shoberg | 292/292 |

*Primary Examiner*—Thomas J. Holko

*Attorney, Agent, or Firm*—Bell, Seltzer, Park & Gibson

[57] ABSTRACT

A portable, auxiliary door lock includes a locking plate having an anchor adapted to be received in the striking plate opening of a door jamb. The locking plate is slidably received by a body portion that has a door-engaging face. The anchor and door-engaging face may be adjustably positioned and secured in place to effect locking of the door by means of a toggle-like pivot assembly mounted on the plate and body portion.

14 Claims, 7 Drawing Figures

PORTABLE AUXILIARY DOOR LOCK

BACKGROUND OF THE INVENTION

1. Field of the Invention

The present invention relates to door locks. It particularly relates to a portable, auxiliary door lock useful for locking doors to hotel rooms, or the like, and having a quick release feature in the form of a pivoting arm.

2. Description of the Prior Art

There is a recognized need for portable auxiliary door locks that may be used to protect against unlawful entry, particularly by those residing in hotel and motel rooms and by those looking for an alternative to the conventional "chain lock". Further, there is a need that any such lock have a quick release or quick unlock feature so that the lock may be disengaged from the door without complex or time-consuming manipulations in the event of a need to quickly exit the room, such as in the case of a fire.

A large number of auxiliary door lock devices have been proposed over the years, many of which include a thin locking plate terminating in an offset end that fits into the striking plate opening of the door jamb and a second member that is slidable with respect to the locking plate and includes a face for abuttment against the inside surface of the door, the two members being capable of securement in a fixed position with respect to each other for effecting locking of the door.

One such device is illustrated in U.S. Pat. No. 3,429,151 wherein the locking plate and second member are secured in place by a padlock. The devices of U.S. Pat. Nos. 1,672,166 and 4,200,317 tighten the two lock members into locking position by means of a threaded connection. A common disadvantage of each of these three devices is that they may not be quickly released or unlocked since they require either the unlocking of a padlock or the retraction of a threaded member.

Numerous other devices have been proposed, but to date there is no commercially available, portable, auxiliary door lock that is simple, rugged and reliable and has the desirable quick release feature.

SUMMARY OF THE INVENTION

The present invention provides a novel and commercially attractive auxiliary door lock that can be economically manufactured and have a useful life of years.

Broadly, the door lock of the invention includes a locking plate that slips into the spaces between the door and the door jamb so that it is anchored to the striking plate. A body portion is slidable on the locking plate and has a face for engaging the door. A toggle-like pivot assembly connects the locking plate and body portion together, provides the force to bias the anchor and face together to lock the door and makes possible the desirable quick release safety feature.

In accordance with one aspect of the invention, there is provided a portable auxiliary door lock including a relatively thin, elongate locking plate having a protruding portion proximate one end thereof defining an anchor to be received in the striking plate opening. The lock further includes a main body portion having a first end formed with a door-engaging face adapted to bear against a marginal portion of a door. The main body portion defines a sleeve slidably receiving the locking plate for reciprocal movement thereof with respect to the body portion. The lock further includes means for controlling the relative reciprocal movement between the locking plate and main body portion and for applying a force to place the door-engaging face and anchor in locking engagement with the door and striking plate. This means comprises an elongate member having first and seconds ends, the first end thereof being pivotally mounted to the locking plate for pivotal movement about a first pivot axis and in a pivot plane substantially normal to the plane of the locking plate. A connector member connects the body portion to the elongate member. The connector member has first and second ends, the first end thereof being pivotalbly mounted to the main body portion for pivotal movement about a second pivot axis such that the connector member pivots in substantially the same plane as the pivot plane of the elongate member. The second end of the connector member is connected to the elongate member adjacent the second end thereof to define a connection point. The first and second axes are respectively positioned such that pivotal movement of the elongate member and connector member in a direction to move the door-engaging face and anchor into locking engagement with the door and striking plate, results in the connection point passing through a dead center position to lock the same while permitting a quick release thereof.

The elongate member may be in the form of an externally threaded rod. The connection of the connector member second end to the elongate member at the connection point may be effected by means threadingly engaged on the threaded rod for linear displacement therealong.

Both the locking plate and main body portion are preferably substantially rectangular with the main body portion sleeve comprising turned-in portions on both sides of the body portion for slidably engaging the sides of the locking plate.

The present invention offers numerous advantages over prior art auxiliary door locks. For example, in accordance with the present invention, once the lock has been adjusted for the relative positioning between the striking plate opening and door face of a particular door, the lock may be secured in place by the pivot action alone without requiring any fine adjustments. Further, all components of the door lock may be made from rugged, metal components, resulting in a useful life measured in years. The door lock may be immediately quick released from locking engagement with the door by simply striking the pivoting elements to release the toggle-like lock. These and many other advantages of the invention will become more apparent from the following detailed description.

BRIEF DESCRIPTION OF THE DRAWINGS

The invention will be more fully understood from the following detailed description thereof taken in connection with the accompanying drawings, which form a part of this application and in which.

DETAILED DESCRIPTION

Figure 1:
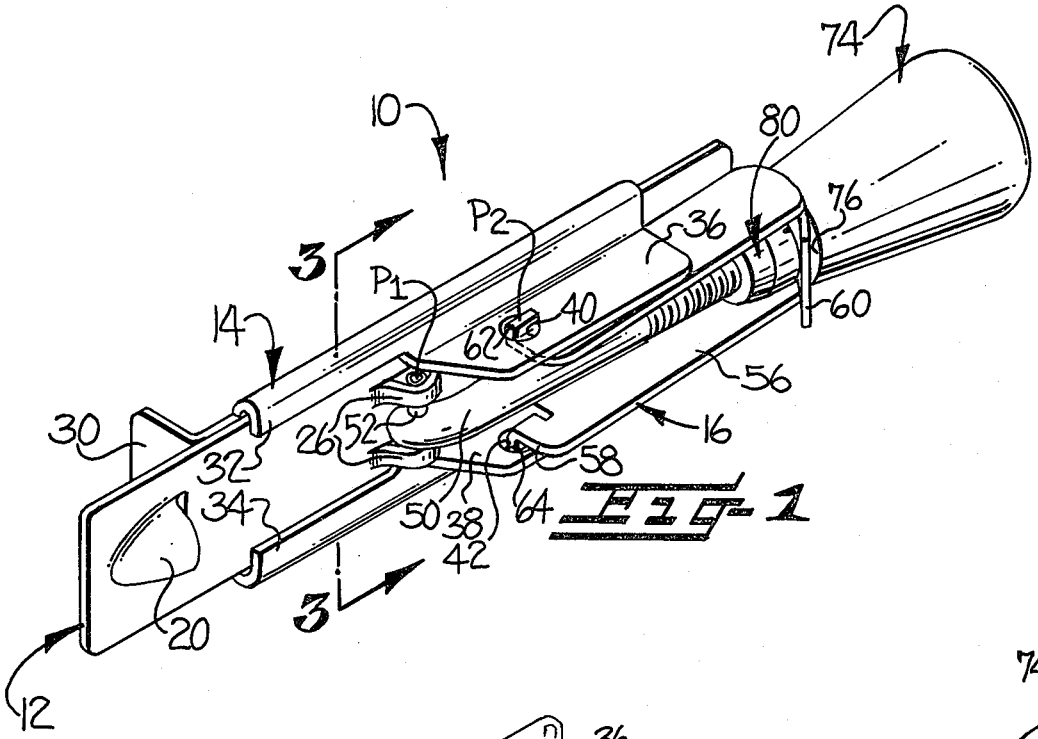
FIG. 1 is an isometric view of one embodiment of the auxiliary door lock of the present invention.

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly, the description is to be understood as a broad enabling teaching directed to persons skilled in the applicable arts, and is not to be understood as restrictive.

Referring to the drawings, there is shown a portable, auxiliary door lock 10 constructed in accordance with the present invention. Door lock 10 includes a relatively thin, elongate locking plate 12, a main body portion 14 and a pivot assembly 16 for effecting locking and unlocking of the device.

Figure 4:
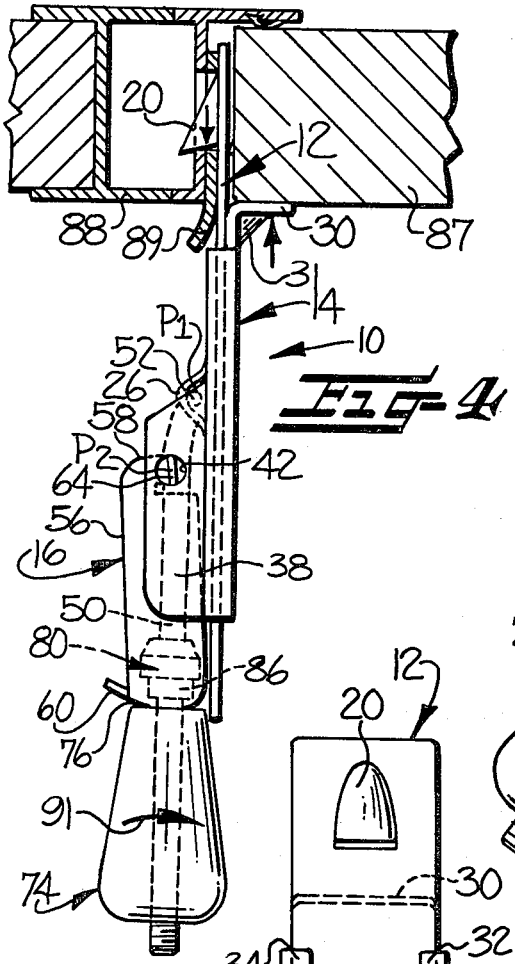
FIG. 4 is a top view of the door lock in locking engagement with a door and associated door jamb.
Figure 5:
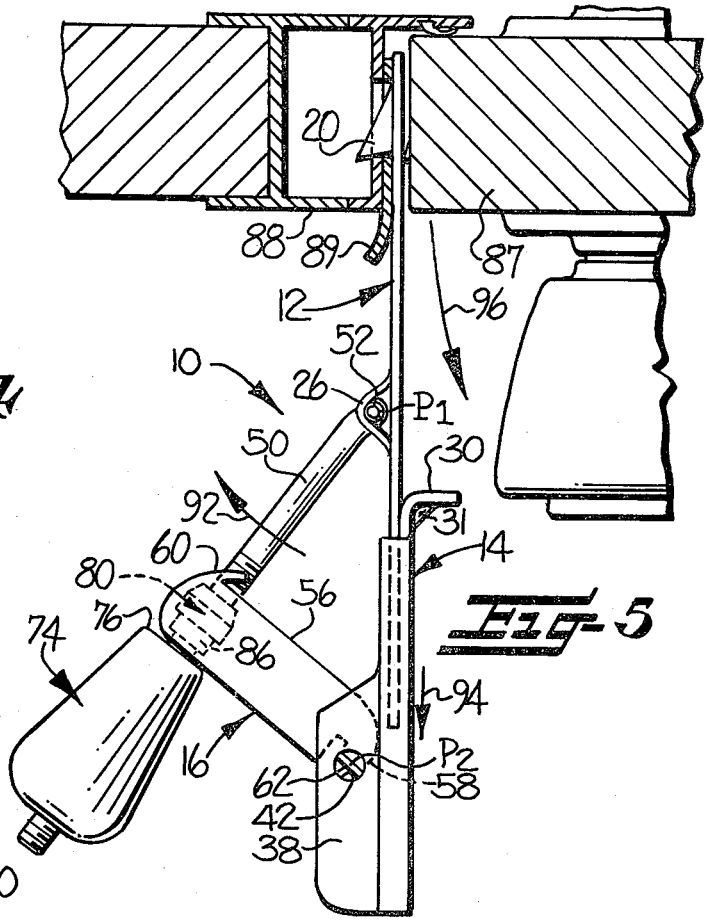
FIG. 5 is a view similar to FIG. 4 and showing the lock after having been moved to the disengaged or unlocked position by moving the arm outwardly.
Figure 6:
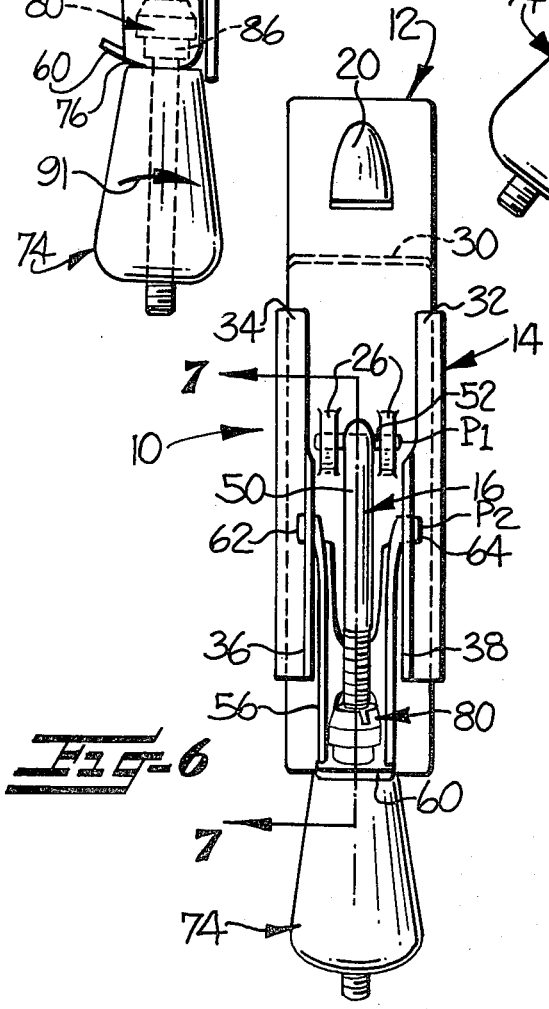
FIG. 6 is a side view of the lock.

Locking plate 12 is preferably substantially rectangular and formed from a flat, rigid material such as steel or aluminum. Locking plate 12 includes a protruding portion proximate one end thereof defining an anchor 20 to be received in the striking plate opening of a door jamb. The anchor may be formed by a punching operation and, as shown in FIGS. 4 and 5, is preferably formed with a negative relief on the order of 15°. Intermediate its length locking bar 12 includes a pair of raised, punched-out retainer portions 26 which, as explained below, are adapted to support the pivoting threaded rod of the pivot assembly.

Main body portion 14 has a first end formed with a door-engaging face 30 that is adapted to bear against a marginal portion of a door. Door engaging face 30 may be reinforced, as by gusset 31. Main body portion 14 also defines a sleeve for slidably receiving locking plate 12 for reciprocal movement of the locking plate with respect to the main body portion. Main body portion 14 preferably is substantially rectangular and substantially the same width as locking plate 12 so that the sleeve may comprise turned-in portions 32, 34 on both sides of the body portion for slidably engaging the sides of the locking plate. Main body portion 14 also includes a pair of upstanding support members 36, 38 formed integrally with turned-in portions 32, 34 respectively. Members 36, 38 include aligned openings 40, 42 that define the pivot axis $P_2$ for the connector member, as described in more detail below.

Thus, it can be seen that anchor 20 is capable of being positioned in the opening of a striker plate, and with the associated door in a closed position, the door-engaging face 30 of main body portion 14 may be brought into contact with a marginal portion of the door. With anchor 20 and door-engaging face 30 secured in this position, the door may be locked against unlawful entry.

Pivot assembly 16 defines means for controlling the relative reciprocal movement between locking plate 12 and main body portion 14 and for applying force to place anchor 20 and door-engaging face 30 in locking engagement with the door and striking plate. Assembly 16 includes an elongate member, preferably in the form of an externally threaded rod 50, that is pivotally mounted to locking plate 12 at one end about a pivot axis $P_1$. The pivotal connection may be made by means of a locking pin 52 residing in retainer portions 26. Thus, threaded rod 50 is attached for pivotal movement toward and away from one face of locking plate 12 in a pivot plane substantially normal to the plane of the locking plate.

Assembly 16 further includes a connector member 56 having a first end 58 and a second end 60. The first end 58 is pivotally secured with respect to main body portion 14 about a pivot axis $P_2$ for pivotal movement of the connector member toward and away from the locking plate in substantially the same plane as the pivot plane of threaded rod 50. The pivoting connection is made by means of a pair of projections 62, 64 that fit into the previously mentioned openings 40, 42, respectively.

The second end 60 of connector member 56 connects to elongate threaded rod 50 adjacent the second end of rod 50 to define a connection point. In the illustrated embodiment connector member second end 60 provides an opening 68 that slidably receives threaded rod 50. Connector member 56 is preferably channel shaped with projections 62, 64 emanating from the opposed channel sides.

Figure 2:
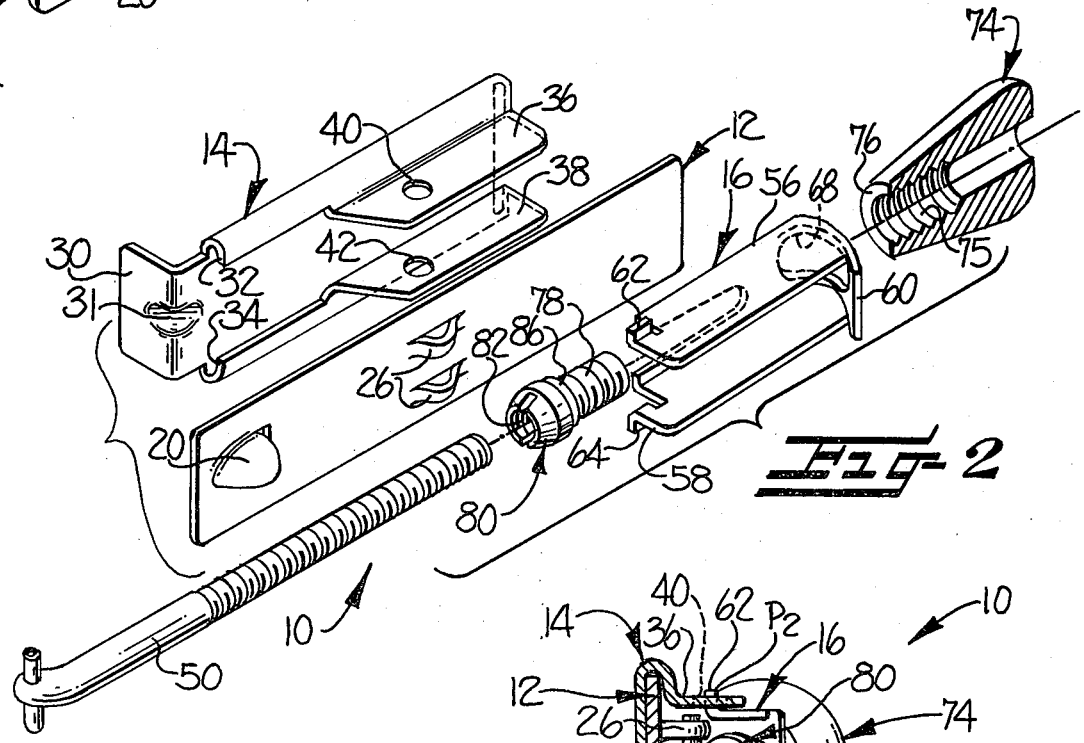
FIG. 2 is an exploded, isometric view of the door lock illustrated in FIG. 1.
Figure 3:
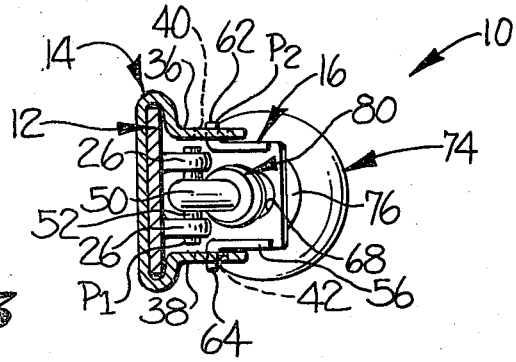
FIG. 3 is a sectional view taken substantially along line 3—3 of FIG. 1.

In the illustrated embodiment, assembly 16 also includes means adjustably positionable along the length of threaded rod 50 for locating the second end of the connector member at selected positions along the threaded rod and for coupling the threaded rod and connector member for pivoting together about their respective pivot axes, $P_1$ and $P_2$. This means preferably comprises a hand-engagable knob 74 having internal threads 75 and an end 76 for engaging the second end 60 of the connector member. The internal threads 75 are adapted to threadingly engage the external threads 78 of an intermediate threaded member 80. As best shown in FIG. 2, intermediate member 80 also includes internal threads 82 for receiving the external threads of rod 50. An annular shoulder 86 formed on intermediate member 80 is formed larger than opening 68 and serves to locate opening 68 between the end 76 of knob 74 and shoulder 86. The knob 74 is preferably tightly secured to intermediate member 80 such that the relative positioning of threads 75 and 78 does not change during operation of the device. Thus, the relative positioning of knob 74 (and connector member second end 60) along threaded rod 50 is achieved by the relative movement of the external threads of threaded rod 50 and the internal threads 82 of member 80.

The connector member second end 60 is preferably curved to provide a surface along which end 76 of knob 74 may bear during operation of the lock. In the illustrated embodiment, the curvature is an arc of a circle having its center substantially along the line connecting the connector member pivot axis $P_2$ to the connector member opening; thus, the radius of curvature of the arc is less than the distance between $P_2$ and opening 68. This configuration results in knob 74, when tightened against end 60, exerting a force substantially parallel to the line of travel of locking member 12 (see FIG. 4). Thus, the force generated by tightening knob 74 against connector member 56 may be directly transferred to locking plate 12.

It can be seen that pivoting of threaded rod 50 and connector member 60 away from locking plate 12 serves to extend the locking plate from main body portion 14 to increase the distance between anchor 20 and door-engaging face 30, while pivoting of members 50, 60 toward locking plate 12 serves to retract the locking plate.

Figure 7:
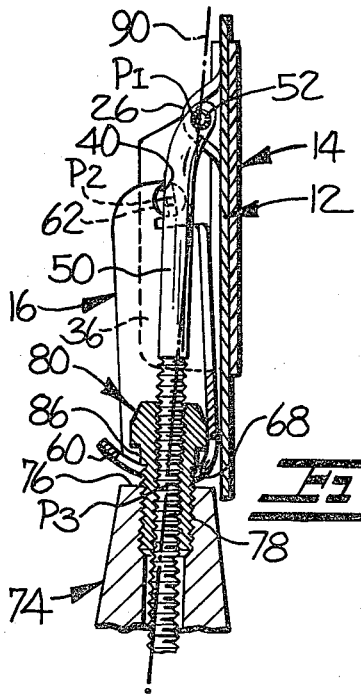
FIG. 7 is a sectional view of a portion of the door lock as taken substantially along line 7—7 of FIG. 6.

FIG. 4 illustrates the door lock in a locked position, preventing relative movement between door 87 and door jamb 88. It can be seen that door-engaging face 30 is contacting a marginal portion of door 87 while anchor 20 resides inside the opening of striking plate 89. Referring to FIG. 7, also showing door lock 10 in the locked position, it can be seen that threaded rod 50 has been moved beyond pivot axis $P_2$ to past dead center. The line designated by reference numeral 90 connects pivot axis $P_1$ to the connection point $P_3$ where threaded rod 50 resides in opening 68 at connector member second end 60. The position of line 90 indicates that threaded rod 50 moved past dead center in the locking operation such that connector member 60 and threaded member 50 are in substantial alignment with locking plate 12. With door lock 10 in this position, the locking engagement may be tightened by rotation of knob 74 in the direction of arrow 91 (FIG. 4).

FIG. 5 illustrates the pivoting of assembly 16 outwardly in the direction of the arrow 92 to effect unlocking of door lock 10. As the assembly is pivoted along line 92, main body portion 14 moves outwardly along arrow 94, thereby moving door-engaging face 30 away from door 87 and permitting the door to swing outwardly along the line 96. With the door moved outwardly from the door jamb, the locking plate 12 may be removed from engagement with the door jamb to complete the unlocking operation. While in normal operation assembly 16 will be moved relatively slowly to effect unlocking, in the event of an emergency door lock 10 may be quickly released by striking knob 74 with the hand or a hand-held object.

While the present invention has been described in connection with a preferred embodiment, it will be appreciated that modifications may be made without departing from the true spirit and scope of the invention.

What is claimed is:

1. A portable auxiliary door lock adapted for use with a door and an assoicated door jamb having a striking plate opening and comprising:

a relatively thin, elongate locking plate including a protruding portion proximate one end thereof defining an anchor to be received in the striking plate opening;

a main body portion having a first end formed with a door-engaging face adapted to bear against a marginal portion of a door, said main body portion including a sleeve slidably receiving said locking plate for reciprocal movement thereof with respect to said body portion;

means for controlling the relative reciprocal movement between said locking plate and main body portion and for applying a force to place the door-engaging face and anchor in locking engagement with the door and striking plate, said means comprising:

an elongate member having first and second ends, the first end thereof being pivotably mounted to said locking plate for pivotal movement about a first pivot axis and in a pivot plane substantially normal to the plane of the locking plate;

a connector member having first and second ends, the first end thereof being pivotably mounted to said main body portion for pivotal movement about a second pivot axis such that said connector member pivots in substantially the same plane as the pivot plane of said elongate member, the second end of said connector member being connected to said elongate member adjacent said second end thereof to define a connection point;

said first and second axes being respectively positioned such that pivotal movement of said elongate member and connector member in a direction to move said door engaging face and anchor into locking engagement with the door and striking plate, results in said connection point passing through a dead center position to lock the same while permitting the quick release thereof.

2. A door lock as claimed in claim 1 wherein said elongate member comprises an externally threaded rod and the connection of said connector member second end to said elongate member at said connection point is effected by means threadingly engaged on said threaded rod for linear displacement therealong.

3. A portable auxiliary door lock adapted for use with a door and an associated door jamb having a striking plate opening and comprising:

a relatively thin, elongate locking plate including a protruding portion proximate one end thereof defining an anchor to be received in the striking plate opening;

a main body portion having a first end formed with a door-engaging face adapted to bear against a marginal portion of a door, said main body portion including a sleeve slidably receiving said locking plate for reciprocal movement thereof with respect to said body portion;

means for controlling the relative reciprocal movement between said locking plate and main body portion and for applying a force to place the door-engaging face and anchor in locking engagement with the door and striking plate, said means comprising:

an elongate member pivotally mounted to said locking plate about a pivot axis $P_1$ for pivotal movement toward and away from a first face of the locking plate in a pivot plane substantially normal to the plane of the locking plate;

a connector member having first and second ends, the first end thereof being pivotally mounted with respect to said main body portion about a pivot axis $P_2$ for pivotal movement of the connector member toward and away from the first face of the locking plate in substantially the same plane as the pivot plane of said elongate member, the second end of said connector member being slidably received on said elongate member;

pivot axis $P_2$ being spaced from the first face of the locking plate by a greater distance than pivot axis $P_1$;

means adjustably positionable along the length of said elongate member for locating the second end of said connector member at selected positions along said elongate member and for coupling said elongate member and connector member for pivoting together about their respective pivot axes $P_1$ and $P_2$;

whereby pivoting of said elongate member and connector member away from said locking plate first face serving to extend said locking plate from said main body portion to increase the distance between said anchor and door-engaging face and pivoting of said members toward the locking plate first face serving to retract the locking plate; and said elongate member, when pivoted toward said locking plate first face, being movable beyond axis $P_2$ to past dead center.

4. A door lock as claimed in claim 3 wherein said elongate member comprises an externally threaded rod and said means for locating comprises a member threadingly engaged on said threaded rod for linear displacement therealong.

5. A door lock as claimed in claim 3 wherein said locking plate is substantially rectangular and wherein said main body portion is substantially rectangular and substantially the same width as said locking plate, said main body portion sleeve comprising turned-in portions on both sides of said body portion for slidably engaging the sides of the locking plate.

6. A door lock as claimed in claim 5 wherein said connector member comprises a substantially channel-shaped portion and wherein said main body portion includes a pair of upstanding support members formed integrally therewith and projecting from said sleeve turned-in portions, the connector member and upstanding support members including cooperating elements defining connector member pivot axis $P_2$.

7. A door lock as claimed in claim 4 wherein said means for controlling relative reciprocal movement and applying force comprises an intermediate threaded member having internal threads threadingly engaging the external threads on said threaded rod and a hand-engagable member connected to said intermediate threaded member such that a portion of said connector member second end is secured therebetween, said intermediate threaded member being linearly movable on said threaded rod in order to selectively position the second end of the connector member along the length of said threaded rod.

8. A portable auxiliary door lock adapted for use with a door and an associated door jamb having a striking plate opening and comprising:

a relatively thin, elongate locking plate including a protruding portion proximate one end thereof defining an anchor to be received in the striking plate opening;

a main body portion having a first end formed with a door-engaging face adapted to bear against a marginal portion of a door, said main body portion including a sleeve slidably receiving said locking plate for reciprocal movement thereof with respect to said body portion whereby said locking plate anchor is caused to move toward and away from said door-engaging face;

means for controlling the distance between said door-engaging face and said anchor and for applying a force to place the door-engaging face and anchor in locking engagement with the door and striking plate, said means comprising:

an elongate, externally threaded rod having one end thereof mounted to said locking plate about a pivot axis $P_1$ for pivotal movement in a pivot plane substantially normal to the plane of the locking plate;

a connector member having first and second ends, the first end thereof being pivotally connected to said main body portion about a pivot axis $P_2$ for pivotal movement of the connector member in substantially the same plane as the pivot plane of said threaded rod, the second end of said connector member providing an opening receiving said threaded rod;

means threadably received on said threaded rod and adjustably positionable thereon for locating said connector member opening at selected positions along said threaded rod and for coupling said threaded rod and connector member for pivoting together about their respective pivot axes $P_1$ and $P_2$;

the threaded rod, pivot axis $P_1$ and connector member pivot axis $P_2$ being located such that the portion of the threaded rod residing in said connector member opening may be moved to a point $P_3$ past dead center when said connector member and threaded rod are moved into substantial longitudinal alignment with said locking plate.

9. A door lock as claimed in claim 8 wherein said locking plate is substantially rectangular and wherein said main body portion is substantially rectangular and substantially the same width as said locking plate, said main body portion sleeve comprising turned-in portions on both sides of said body portion for slidably engaging the sides of the locking plate.

10. A door lock as claimed in claim 8 wherein said connector member comprises a substantially channel-shaped portion and said main body portion includes a pair of upstanding support members, the connector member and upstanding support members including cooperating elements defining connector member pivot axis $P_2$.

11. A door lock as claimed in claim 9 wherein said connector member comprises a substantially channel-shaped portion and wherein said main body portion includes a pair of upstanding support members formed integrally therewith and projecting from said sleeve turned-in portions, the connector member and upstanding support members including cooperating elements defining connector member pivot axis $P_2$.

12. A door lock as claimed in claim 8, 9, 10 or 11 wherein said means for controlling relative reciprocal movement and applying force comprises:

an intermediate threaded member having internal threads threadingly engaging the external threads on said threaded rod and having an annular shoulder for engaging a first face of the connector member opening; and a hand-engagable member connected to said intermediate threaded member and having an end engaging a second face of the connector member opening, said intermediate threaded member being linearly movable on said threaded rod in order to selectively position the second end of the connector member along the length of said threaded rod.

13. A door lock as claimed in claim 8 wherein the connector member second end is curved.

14. A door lock as claimed in claim 13 wherein the curvature of the connector member second end is an arc of a circle having its center substantially along the line connecting the connector member pivot axis $P_2$ to the connector member second end opening.

* * * * *